United States Patent [19]

Oshizawa

[11] Patent Number: 4,748,447

[45] Date of Patent: May 31, 1988

[54] TIMING SIGNAL GENERATING APPARATUS FOR ROTATING DEVICES

[75] Inventor: Hidekazu Oshizawa, Higashimatsuyama, Japan

[73] Assignee: Diesel Kiki Co., Ltd., Japan

[21] Appl. No.: 870,787

[22] Filed: Jun. 5, 1986

[30] Foreign Application Priority Data

Jun. 13, 1985 [JP] Japan ..... 60-127113

[51] Int. Cl.[4] ..... G08B 29/00

[52] U.S. Cl. ..... 340/870.20; 340/870.31; 324/166; 73/119 A

[58] Field of Search ..... 340/870.02, 870.20, 340/870.24, 870.31; 324/391, 392, 381, 389, 166–169; 123/205, 206; 73/119 A, 113

[56] References Cited

U.S. PATENT DOCUMENTS

| | | | |
|---|---|---|---|
| 4,158,305 | 6/1979 | Shipley | 324/392 |
| 4,262,251 | 4/1981 | Fujishiro et al. | 324/392 |
| 4,296,471 | 10/1981 | Goux | 324/391 |
| 4,356,447 | 10/1982 | Hönig et al. | 324/169 |
| 4,485,452 | 11/1984 | Cording et al. | 324/166 |
| 4,572,122 | 2/1986 | Kamai et al. | 123/206 |

*Primary Examiner*—John W. Caldwell, Sr.
*Assistant Examiner*—Tyrone Queen
*Attorney, Agent, or Firm*—James Creighton Wray

[57] ABSTRACT

In a timing signal generating apparatus for generating a timing signal showing that a rotating member has reached a target rotational angle position, the apparatus comprises a first generator for generating scale pulses every time the rotating member rotates N degrees, a second generator for generating a reference pulse used for discriminating a prescribed scale pulse from other scale pulses, and a calculator for performing a calculation in which a target rotational angle position of the rotating member is the dividend and N is the divisor and outputs first and second calculation data representing the quotient A and the remainder B respectively. The apparatus is responsive to the reference pulse, the scale pulses and the result of the first calculator and produces a first timing pulse indicating the timing when the rotating member has assumed a rotational angle position indicated by N×A degrees and produces a second timing pulse with a pulse width determined according to the second calculation data in response to the first timing pulse.

8 Claims, 3 Drawing Sheets

TARGET FUEL QUANTITY CALCULATING UNIT
SENSOR UNIT
FIRST PULSE GNERATOR
LIFT SENSOR
COUNTER
STP
ST
CLK
F/F
S
R
Q
MEASURING UNIT
CLOCK PULSE GENERATOR
DIESEL ENGINE
SPEED DETECTOR
DN
DS
To
Pt
DP
PL
CD
CL
Pr
SN
1
2
3
4
5
5a
6
7
7a
7b
7c
7d
7e
8
9
10
11
12
14
15
16
18
19
20
26
27
27a
28
151
152
A
B
C
D
E
F
C1
C2
C3
C4

Pr
0°

SN
10°
10°
10°
10°
10°
10°
10°

CONTENT OF DATA DR
0
1
2
3
4
5
6

LEVEL OF OUTPUT LINE 29a
48°

Pt
8°

DP

POSITION OF VALVE BODY 7b
CLOSING POSITION
OPENING POSITION

FUEL PRESSURE IN HIGH PRESSURE CHAMBER 6

FUEL PRESSURE AT FUEL INJECTION NOZZLE
ty

PL
td
t1
t2
t3
t4
t5
t6
t7
t8
t9
t10
t11
t12

TIMING SIGNAL GENERATING APPARATUS FOR ROTATING DEVICES

BACKGROUND OF THE INVENTION

The present invention relates to a timing signal generating apparatus for a rotating device, and more particularly to a timing signal generating device for a rotating device for obtaining, by way of example, a timing signal for controlling the fuel injection timing etc. of a fuel injection pump.

Generally, in the case where electrical control is performed with respect to a rotating device such as an electric motor, internal combustion engine or the like, it is frequently necessary to obtain a timing signal which accurately indicates the desired rotation timing of the rotating device. Such a timing signal becomes necessary in the case where the injection timing of fuel is electronically controlled so as to obtain an optimum injection timing corresponding to the operating condition of the engine. In order to obtain such a timing signal in a conventional internal combustion engine, there is generally used a pulse generator for generating a pulse every time the rotating shaft or the like of the engine rotates a predetermined angle, and the rotation angle at each instant is detected by counting the number of pulses output from the pulse generator (Japanese Patent Public Disclosure Nos. Sho 57-124208 and Sho 58-86407).

According to the conventional construction, it is necessary to increase the density of pulse generation from the pulse generator in order to increase the accuracy of the timing signal, and in order to do this, the number of cogs or slits of the pulser of the pulse generator must be increased. However, there is a limit to the number of cogs or slits that can be provided from the point of view of mechanical construction. Furthermore, from the fact that increasing the number of cogs or slits raises the manufacturing cost, there is also an economic limit on increasing the density of pulse generation. Because of this, there has been proposed a device in which the timing between two successive cogs or slits is determined by interpolation or by multiplying the frequency of the output pulse signal. However, no prior art device is able to provide the desired timing signal with high accuracy in the case where the engine speed suddenly changes, so that highly accurate timing control has not been possible.

SUMMARY OF THE INVENTION

It is an object of the present invention to provide an improved timing signal generating apparatus which is capable of generating a timing signal with high accuracy.

It is another object of the present invention to provide a timing signal generating apparatus for a rotating device wherein a timing signal indicating a desired timing of the rotating device can be output with high accuracy without increasing the pulse generating density of a rotation pulse generator.

According to the present invention, in a timing signal generating apparatus for rotating devices which outputs a timing signal showing that a rotating member of the rotating device has reached a target rotational angle position, the apparatus comprises means for producing a first data representing the target rotational angle position as an angular position of the rotating member, a first generating means for generating scale pulses every time the rotating member rotates N degrees, a second generating means for generating a reference pulse used for discriminating a prescribed scale pulse from other scale pulses, and a calculating means responsive to the first data which performs a calculation in which the above-mentioned target rotational angle position is the dividend and N is the divisor and outputs first and second calculation data which are determined in relation to the quotient A and the remainder B respectively. The apparatus further comprises a first means responsive to the reference pulse, the scale pulses and the first calculating data for producing a first timing pulse indicating the timing when the rotating member has assumed a rotational angle position indicated by N×A degrees and a second means for producing a second timing pulse with a pulse width determined according to the second calculation data in response to the first timing pulse.

When the rotating member rotates, the reference pulses and the scale pulses are output, and each of a plurality of scale pulses generated during one revolution of the rotating member can be put into sequence by a single reference pulse generated during the same revolution. The scale pulse which has been determined as "number one" by the reference pulse is defined as a zero point pulse corresponding to the origin from which the rotational angle position of the rotating member is measured. As a result, the various rotation angle positions N, 2N, . . . can be shown by the use of the sequentially output scale pulses.

The first means detects the scale pulse which corresponds to the rotational angle position of N×A degrees in response to the reference pulse, the scale pulses, and the first calculating data, and outputs the first timing pulse which indicates this timing. Consequently, the timing which indicates the rotational position of N×A degrees can be detected accurateley without being affected by the rotational speed of the rotating member. The first timing pulse is applied to the second means wherein the second timing pulse is output just after the time shown by the second calculation data from the output timing of the first scale pulse output after the output of the first timing pulse.

As described above, the output timing of the first timing pulse is determined on the basis of data relating to the angular position of the rotating member, and no factor concerning time is included at all. Therefore, even if there is a sudden change in the rotational speed of the rotating member, there is no influence upon the accuracy of the output timing. Since only the output timing of the second timing pulse is controlled timewise by the second means, even if there is a sudden change in the rotational speed of the rotating member, the effects are extremely small. As a result, even if the generation density of the scale pulse is not greatly increased, the desired timing signal can be generated with high accuracy.

The invention will be better understood and other objects and advantages thereof will be more apparent from the following detailed description of preferred embodiments with reference to the accompanying drawings.

DESCRIPTION OF THE PREFERRED EMBODIMENTS

Figure 1A:
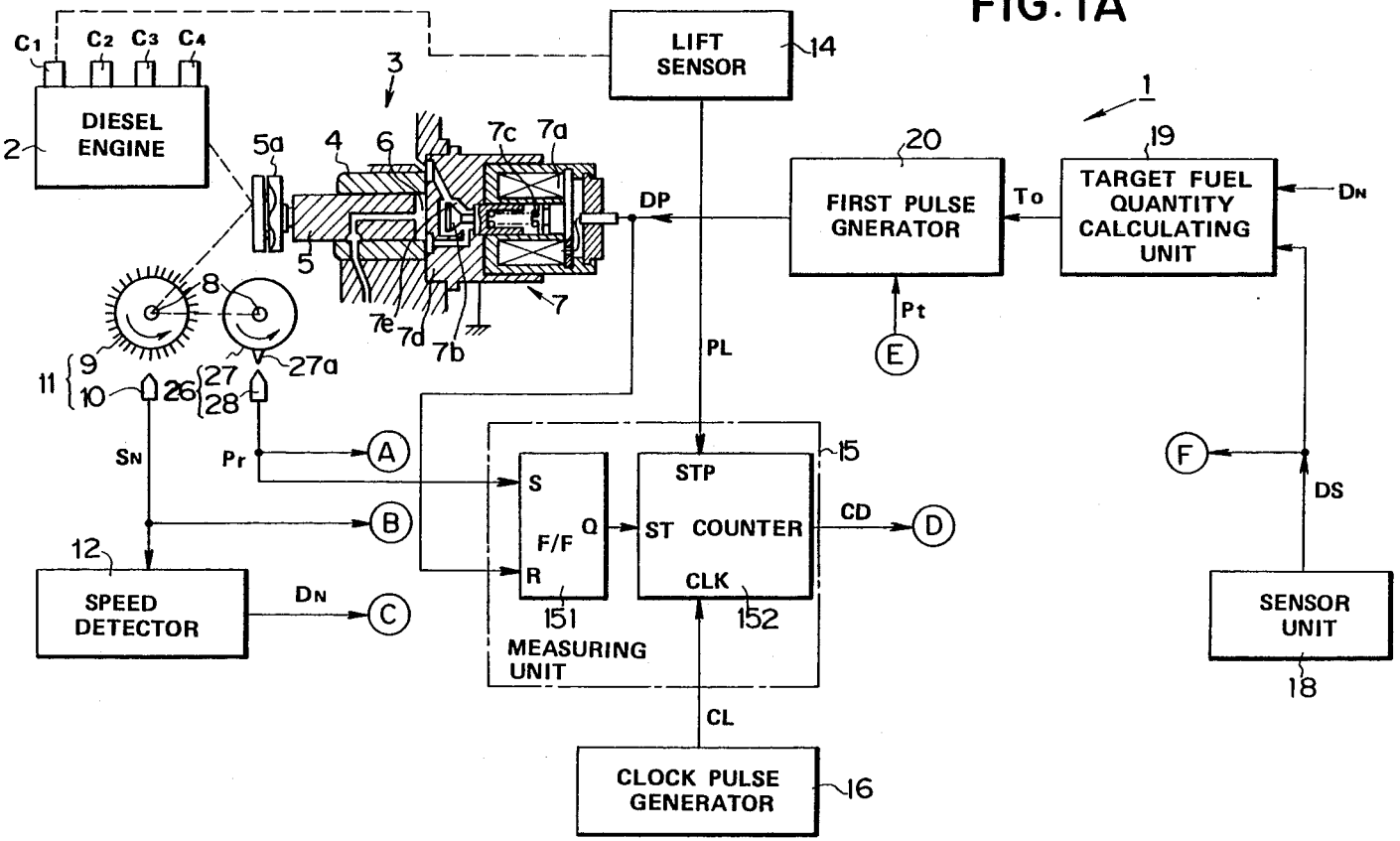
FIG. 1A is a block diagram showing an embodiment of a timing signal generating apparatus for rotating devices according to the present invention.

FIG. 1A is a block diagram showing an embodiment of a fuel injection timing control apparatus for internal combustion engines to which is applied a timing signal generating apparatus according to the present invention. The fuel injection apparatus 1 comprises a fuel injection pump 3 which is driven by a diesel engine 2 and injects a supply of fuel to the diesel engine 2. In the embodiment shown in FIG. 1A, this fuel injection pump 3 is a distribution-type fuel injection pump, and a plunger 5 which is inserted in a plunger barrel 4 rotates with reciprocal movement according to the cam profile of a cam disc 5a driven by the rotational input power from the diesel engine 2. As a result, the fuel pressurized within a high pressure chamber 6 is supplied under pressure to the individual cylinders $C_1$ to $C_4$ of the diesel engine 2 in sequence. In order to control the fuel quantity, this fuel injection pump 3 is provided with a normally-opened type solenoid valve 7 having an exciting coil 7a, whereby the high pressure chamber 6 can be communicated with the lower pressure portion within the fuel injection pump 3. When a driving pulse DP, which is output in the manner to be described later, is applied to the exciting coil 7a so that the exciting coil 7a is excited, a valve body 7b moves in the right-hand direction in FIG. 1A against the force of a return spring 7c, and is seated on a valve seat 7e formed in a valve casing 7d, whereby the solenoid valve 7 is put into a closed state.

When the solenoid valve 7 is in an open state, the high pressure chamber 6 is made to communicate with the lower pressure portion and consequently, fuel will not be injected therefrom even if the plunger 5 performs lifting operations.

On the other hand, when the solenoid valve 7 is closed by the energization of the exciting coil 7a, the high pressure chamber 6 is disconnected from the lower pressure portion, the fuel is pressurized in the high pressure chamber 6 in accordance with the lifting operation of plunger 5, and a state in which fuel can be supplied is created. When solenoid valve 7 is opened during the supplying of fuel, the pressurized fuel within the high pressure chamber 6 is released, and the fuel supplying operation under pressure is terminated.

A fuel injection pump which is constructed to control the timing of the start and termination of pressurized fuel supply by the use of a solenoid valve as stated above, is widely known per se, so that in FIG. 1A, only the main portions of the structure are shown, and the structural details are shown in simplified form.

In order to detect the rotational state of a driving shaft 8 of the fuel injection pump 3, the driving shaft 8 is equipped with a first sensor 11 and a second sensor 26. The first sensor 11 consists of a pulser 9 and an electromagnetic pick-up coil 10 located adjacent thereto. 36 cogs are provided on the outer periphery of the pulser 9 at 10 degrees intervals, so that scale pulses are generated from the electromagnetic pick-up coil 10 once every 10 degree rotation of the driving shaft 8. A pulse train signal consisting of these scale pulses is derived as a pulse signal $S_N$ therefrom and is applied to a speed detector 12. In the speed detector 12, the time interval between two succeeding pulses of the pulse signal $S_N$ is measured, and speed data $D_N$ which represents the speed of the diesel engine 2 at each instant is output on the basis of the result of the measurement. The content of the speed data $D_N$ is renewed every time a signal is output from the electromagntic pick-up coil 10; in other words, every time the driving shaft 8 rotates 10 degrees, and the renewed data is supplied to a timing control unit 13 (shown in FIG. 1B) for controlling the fuel injection timing of the fuel injection pump 3.

The pulser 9 is secured to the driving shaft 8 such a way that one predetermined cog out of 36 cogs provided on the outside of pulser 9 is facing the electromagnetic pick-up coil 10 at a time before when the driving pulse DP for the injection of fuel into cylinder $C_1$ is output just before the piston (not shown) provided in the cylinder $C_1$ of the diesel engine 2 has reached its top dead center for compression, but after when the driving pulse DP one prior to it has fallen in level. In order to be able to know beforehand the time when the predetermined cog comes to face opposite the electromagnetic pick-up coil 10, there is provided the second sensor 26 having a pulser 27 with a single cog 27a and an electromagnetic pick-up coil 28 associated with the pulser 27. The pulser 27 is secured on the driving shaft 8 in such a way that the cog 27a comes to face opposite the electromagnetic pick-up coil 28 at a time which is later than the time when the cog one prior to the predetermined cog if the pulser 9 comes to face opposite the electromagnetic pick-up coil 10 but is earlier than the time when the predetermined cog comes to face opposite the electromagnetic pick-up coil 10. Consequently, the signal output from the first sensor 11 just after the reference pulse $P_r$ is generated as a TDC pulse from the second sensor 26 when the cog 27a comes to face opposite the electromagnetic pick-up coil 10, represents the timing of the top dead center in the cylinder $C_1$. As a result, the generation of this TDC pulse included in the pulse signal $S_N$ output from the first sensor 11 can, by using the reference pulse $P_r$, be discriminated from the other pulses produced by the second sensor 11.

The diesel engine 2 is a 4-cycle, 4-cylinder engine having cylinders $C_1$ through to $C_4$, and in order to detect the lift timing of the needle valve of the fuel injection nozzle (not shown) which is installed on cylinder $C_1$, a lift sensor 14 is provided in the fuel injection nozzle. Every time fuel is injected into cylinder $C_1$, the lift sensor 14 outputs a lift pulse PL which indicates the timing at which the injection nozzle opens due to the lifting of the needle valve resulting from the pressure of the pressurized fuel.

In order to measure the injection delay time, namely the period from the time when the driving pulse DP is output to the time when the fuel injection into the cylinder corresponding to the driving pulse is started, the lift pulse PL and the driving pulse DP are applied to a measuring unit 15 to which the reference pulse $P_r$ is also input. The measuring unit 15 has a flip-flop 151, and the reference pulse $P_r$ and the driving pulse DP are input to the set terminal S and the reset terminal R thereof, respectively. The flip-flop 151 is adapted to be set by the reference pulse $P_r$ and to be reset when the level of the driving pulse DP changes from "L" to "H". The output terminal Q of the flip-flop 151 is connected to the start terminal ST of a binary counter 152 having a stop terminal STP to which the lift pulse PL is applied, and clock pulses CL generated by a clock pulse generator 16 are applied to a clock terminal CLK of the counter 152. The counter 152 is reset and starts to count the clock pulses CL when the level of the output terminal Q changes from "H" to "L", and the counting operation of the counter 152 stops when the lift pulse PL is applied to its stop terminal STP. The counting result of the counter 152 is output as counting data CD.

Thus, the counter 152 is reset by the flip-flop 151 in response to the rise in the level of the driving pulse DP for the fuel injection to the cylinder $C_1$, and at the same time, the counter 151 starts to count the number of clock pulses CL generated by the clock pulse generator 16. The counting operation of the counter 152 is terminated in response to the application of the lift pulse PL, whereby the number of clock pulses generated during the period from the time when the level of the driving pulse DP concerned changes from "L" to "H" to the time when the lift pulse PL is output is counted. As a result, the counting data CD output from the measuring unit 15 shows the injection delay time.

The block denoted by the numeral 18 is a sensor unit which detects a predetermined operating condition of the diesel engine 2 other than the rotational speed of the diesel engine 2 and outputs operating condition data DS showing the result of the detection. The operating condition data DS from the sensor unit 18 is applied to a target fuel quantity calculating unit 19 to which the speed data DN is also applied.

The target fuel quantity calculating unit 19 calculates the optimum fuel quantity for the operating condition of the diesel engine 2 at each instant on the basis of predetermined governor characteristic data in response to the operating condition data DS and the speed data DN. The target fuel quantity calculating unit 19 outputs valve closing time data $T_o$ representing the closed period of the solenoid valve 7 required for obtaining the optimum fuel quantity from the fuel injection pump 3.

The valve closing time data $T_o$ is input to a first pulse generator 20 as data for determining the pulse width of the driving pulse DP, and when a timing pulse $P_t$, which is produced as will be described later, is applied to the first pulse generator 20 as a trigger pulse, a driving pulse DP with a pulse width determined by the valve closing time data $T_o$ at that time is generated from the first pulse generator 20 and applied to the exciting coil 7a of the solenoid valve 7.

Figure 1B:
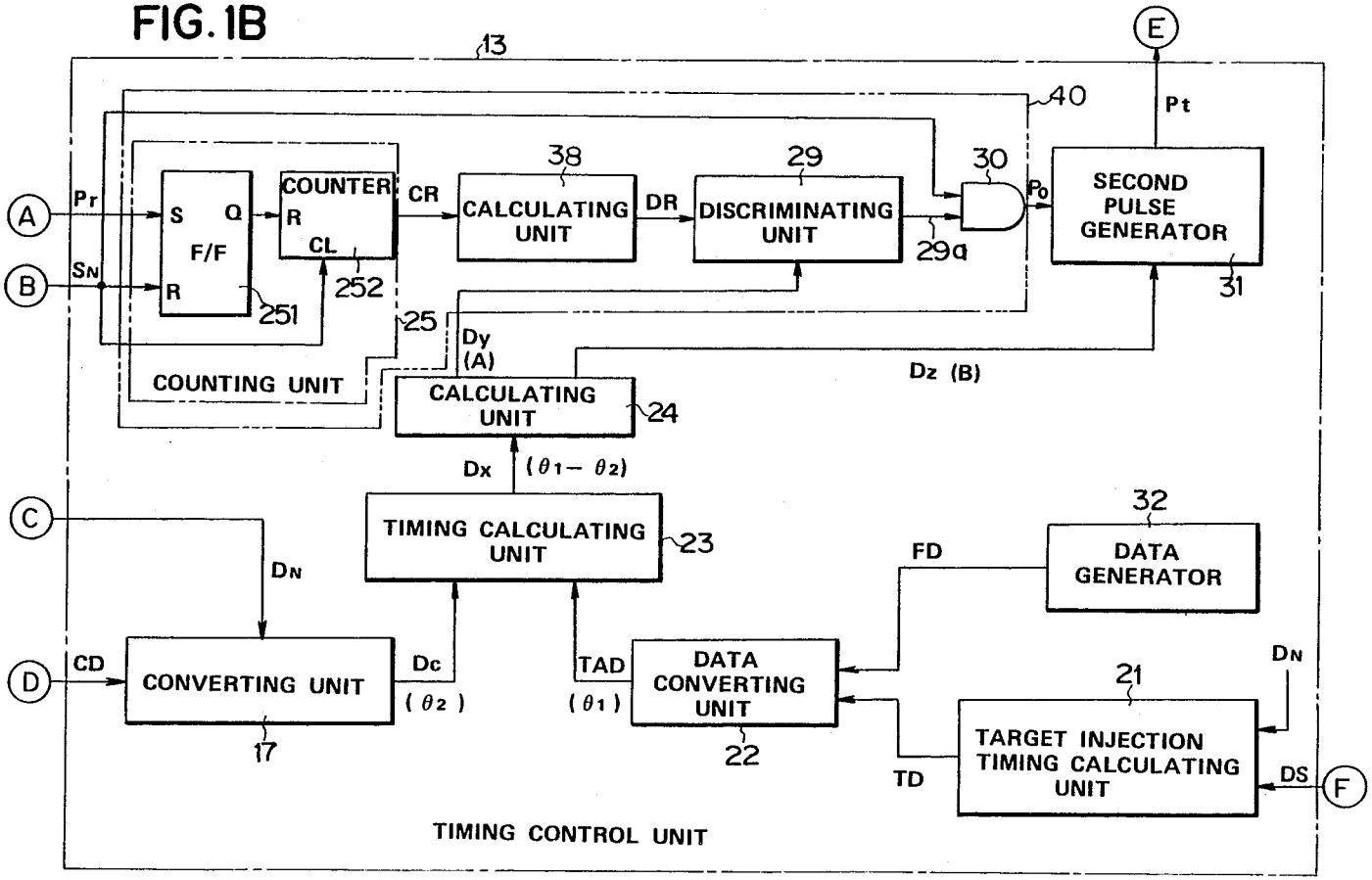
FIG. 1B is a block diagram of a timing control unit used with FIG. 1A.

In the following, description will be given of a timing control unit 13 shown in FIG. 1B for determining the timing of the output of the driving pulse DP from the first pulse generator 20.

The timing control unit 13 has a converting unit 17 which receives the counting data CD and the speed data DN and on the basis of these data converts the injection delay time represented by the counting data CD into the corresponding amount of rotation angle of the driving shaft 8. More specifically, the converting unit 17 converts the time represented by the counting data CD into the amount of rotation angle of the driving shaft 8 based on the engine speed at each instant shown by the speed data DN, and the angle $\theta_2$ resulting from this conversion is output as correction data $D_c$. As can be understood from the above description, the delay time includes not only the operation delay, i.e. the time from the application of the driving pulse DP to solenoid valve 7 to the actual closing of the solenoid valve 7, but also the fuel transmission delay time, i.e. the period up to when the pressurized fuel is actually supplied in the cylinder.

The timing control unit 13 also has a target injection timing calculating unit 21 which, in response to the operating condition data DS and the speed data DN, calculates an optimum injection timing for the operating condition of the diesel engine 2 at each instant and outputs target timing data TD representing the calculated optimum injection timing to a data converting unit 22. The data converting unit 22 also receives data FD produced by a data generator 32 and representing the time period between the instant when the piston of cylinder $C_1$ of diesel engine 2 reaches top dead center and the instant of output of the pulse signal $S_N$ output just after the reference pulse $P_r$. The data FD is expressed as the difference in the angular position of the driving shaft 8 between said two instants.

That is, the data FD shows the angular difference between a reference angular position of the driving shaft 8 of the fuel injection pump 3 and that of the crankshaft of the diesel engine 2 when they are connected. the data FD can be set at the required value in the data generator 32 on the basis of the actual angular difference which depends on the state of connection between the driving shaft 8 of the fuel injection pump 3 and the crankshaft of the diesel engine 2.

Based on these data FD and TD, the data converting unit 22 outputs target angle data TAD representing the angle $\theta_1$ of the driving shaft 8 corresponding to the target injection advance angle value.

The target angle data TAD represents the angular position of the driving shaft 8 at which the injection of fuel should actually start, while the correction data $D_c$ represents the length of the period between the instant the driving pulse DP is output and the instant the injection of fuel is actually started, as the angle of driving shaft 8. In order to obtain data showing the time at which the driving pulse DP should be output on the basis of the data TAD and $D_c$, there is provided a timing calculating unit 23. The timing calculating unit 23 calculates the difference between the driving shaft angle $\theta_1$ represented by a target angle data TAD and the driving shaft angle $\theta_2$ represented by correction data $D_c$. Data $D_x$ representing the difference $\theta_0-\theta_2$ is output from the timing calculating unit 23 and input to a calculating unit 24.

In the calculating unit 24, an angle of 10 degrees, which is the angular interval between the cogs on the outer surface of pulser 9, is subtracted from the angle $0_1-\theta_2$ represented by the data $D_x$.

The calculated result $(\theta_1-\theta_2-10)$ is divided by 10 degrees which is the interval of the arrangement of the cogs of the pulser 9. As a result, there are obtained data $D_y$ and $D_z$ whose contents are determined in relation to the quotient A and the remainder B of the calculated result. In this embodiment, data $D_y$ indicates the quotient A and data $D_z$ indicates the remainder B.

Data $D_y$ is applied to a timing detecting unit 40, which operates in response to the pulse signal $S_N$ and the reference pulse $P_r$ to detect the timing at which the driving shaft 8 has reached an angular position represented by $10\times A$. The timing detecting unit 40 is provided with a counting unit 25 to which the pulse signal $S_N$ and the reference pulse $P_r$ are input. The counting unit 25 has a flip-flop 251, and the reference pulse $P_r$ and the pulse signal $S_N$ are input to the set terminal S and the reset terminal R thereof, respectively. The flip-flop 251 is adapted to be set by the application of the reference pulse $P_r$ and to be reset by the application of the pulse of the pulse signal $S_N$. The output terminal Q of the flip-flop 251 is connected to the reset terminal R of a binary counter 252 having a clock terminal CL to which the pulse signal $S_N$ is applied as clock pulses. The counter 252 is reset and starts to count the pulses of the pulse signal $S_N$ when the level of the output terminal Q of the flip-flop 251 changes from "H" to "L". The counting result of the counter 252 is output as data CR.

Thus, the counter 252 is reset by the pulse signal $S_N$ which is output just after the reference pulse $P_r$ is output, after which the content of the counting is incremented by one every time the pulse signal $S_N$ is output.

The data CR which represent the result of this counting is input to a calculating unit 38 wherein the contents of data CR is divided by 9, and the remainder of this division is output as data DR. This operation is carried out because the diesel engine 2 is a 4-cycle, 4-cylinder engine wherein the piston assumes the top dead center position for compression 4 times during one rotation of the pulser 9. The data DR from the calculating unit 38 is input to a discriminating unit 29 wherein a discrimination is made as to whether or not the content of the data $D_y$ agrees with the content of the data DR. The level of the output line 29*a* of the discriminating unit 29 becomes "H" only in the case where the content of the data DR coincides with that of the data $D_y$.

One input terminal of an AND gate 30 is connected to the output line 29*a*, and the other input terminal thereof is connected to the electromagnetic pick-up coil 10. Consequently, when the pulse signal $S_N$ is output during the high level state of the output line 29*a*, the pulse signal $S_N$ is derived through the AND gate 30 and is output as an output pulse $P_o$ of the timing detecting unit 40. In this embodiment, since the contents of data $D_y$ is set to A, when the contents of data DR become A, the level of the output line 29*a* becomes "H". Therefore, the (A+2) th scale pulse after the generation of a reference pulse $P_r$ is output from the AND gate 30 as the output pulse $P_o$. The description concerning this operation will be given later in more detail with reference to FIGS. 2A through to 2J.

The output pulse $P_o$ is applied as a trigger signal to the second pulse generator 31 to which data $D_z$ is input as information for determining the width of its output pulse. When the output pulse $P_o$ is applied to the second pulse generator 31, a timing pulse $P_t$ with a pulse width corresponding to data $D_z$ is output from the second pulse generator 31. As described above, in this case, data $D_z$ represents the rotation angle B (<10°) of the driving shaft 8 and the pulse width of the timing pulse $P_t$ is set so that it is a period corresponding to the rotation angle B of the driving shaft 8 at that time. Since the rising timing of the timing pulse $P_t$ shows $10\times A+10$ degrees of the driving shaft 8, the timing at the trailing edge of the timing pulse $P_t$ is equal to $10\times A+10+B$; that is, to an angular timing of $\theta_1-\theta_2$.

The first pulse generator 20 is triggered at the timing of the trailing edge of the timing pulse $P_t$, and the driving pulse DP whose pulse width is determined by the valve closing time data $T_o$, is output at the timing of $\theta_1-\theta_2$.

Figures 2A, 2B, 2C, 2D, 2E, 2F, 2G, 2H, 2I, 2J:
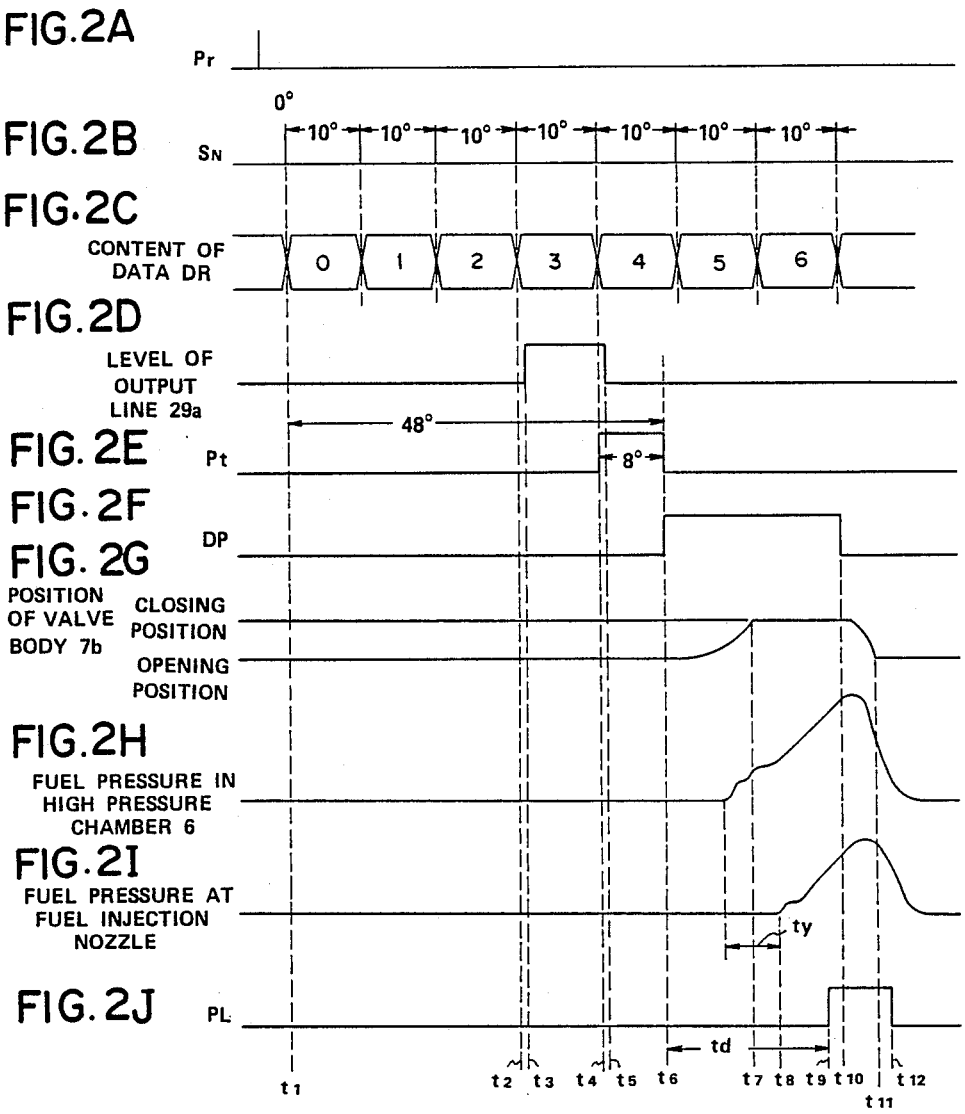
FIGS. 2A to 2J are time charts for describing the operation of the apparatus shown in FIG. 1A.

A description of the operation of the fuel injection apparatus 1 shown in FIG. 1A will be given with reference to FIGS. 2A to 2J. FIG. 2A shows a waveform of the reference pulse $P_r$ and FIG. 2B shows a waveform of a pulse signal $S_N$. The reference pulse $P_r$ is a pulse train signal consisting of pulses of which one is output every time the driving shaft 8 rotates 360 degrees, while the pulse signal $S_N$ is a pulse train signal which consists of pulses of which one is output every time the driving shaft 8 rotates 10 degrees. As previously stated, in the present apparatus 1, the data converting unit 22 produces the target angle data TAD in which the target injection timing is represented as the angular position of the driving shaft 8, and the converting unit 17 produces the correction data $D_c$ in which the magnitude of the fuel injection delay is represented as the angular position of the driving shaft 8. Both data TAD and $D_c$ are input into the timing calculating unit 23 and the calculation of the difference between the angular position $\theta_1$ represented by the target angle data TAD and the amount $\theta_2$ of rotation represented by the correction data $D_c$ is performed. In order to present the rest of the description more concretely, $\theta_1$ will be given the value 70 degrees, and $\theta_2$ the value 22 degrees. Accordingly, the content of the data $D_x$ output from the timing calculation unit 23 becomes 48 degrees. The calculating unit 24 outputs data $D_y$ which has as its content the number 3 which is the ten-place digit of the calculation 48°−10°(=38°), and the data $D_z$ which has as its content the number 8 which is the one-place digit of the angle 38°.

The counter 252 is reset at the time $t=t_1$ when the output timing of the pulse signal $S_N$ which is output just after the output of the reference pulse $P_r$ is output, after which the counting value is incremented by one every time an individual pulse of the pulse signal $S_N$ is output. The contents of data DR are shown in FIG. 2C. Thus, every time the fourth pulse after the generation of the reference pulse is input into the counting unit 25 at $t=t_2$, the content of data CR becomes 3, so that the content of data DR also becomes 3, and in response to this, the level of the output line 29*a* of the discriminating unit 29 changes from "L" to "H". The actual timing of the level change of the output line 29*a* from "L" to "H" is at $t=t_3$, which is a short time later than $t_2$ due to the response delay in the circuit (FIG. 2D). When the fifth pulse after the generation of the reference pulse is output at $t=t_4$, the content of data DR becomes 4, so that the level of the output line 29*a* of the discriminating unit 29 changes from "H" to "L". Also in this case, due to the delay in response in the circuit, the time at which the level of the output line 29*a* changes from "H" to "L" is $t=t_5$ which is a short time after $t_4$ (FIG. 2D).

Therefore, the AND gate 30 is open when the fifth pulse is output at $t_4$, that is, when the driving shaft 8 rotates 40 degrees from the output of the first scale pulse (FIGS. 2B and 2D), and the second pulse generator 31 is triggered by the fifth pulse output at $t_4$. Data $D_z$ which has 8 as its content, is applied to the second pulse generator 31, from which the timing pulse signal $P_t$ which has a pulse width corresponding to 8 degrees of the angle of rotation of the driving shaft 8 which is represented by the data $D_z$ is generated when triggered (FIG. 2E). That is to say, the timing of the trailing edge of the timing pulse signal $P_t$ represents a timing in which the driving shaft 8 has rotated 48 degrees from the output timing of the pulse signal $S_N$ which is produced just after the generation of the reference pulse $P_r$.

The timing pulse signal $P_t$ is input as a trigger pulse to the first pulse generator 20, and the driving pulse DP having a pulse width determined by the valve closing time data $T_o$ in response to the change in level from "H" to "L" is output at $t=t_6$ (FIG. 2F).

When the driving pulse DP shown in FIG. 2F is applied to the exciting coil 7 of the solenoid valve 7, the valve body 7*b* starts to move a short time after $t=t_6$ as shown in FIG. 2G due to the delay in its response, and the valve body 7b has reached its completely closed position at t=t7. When the level of the driving pulse DP changes from "H" to "L" at $t=t_{10}$, the valve body 7*b* starts to move a short time later due to this change, and the valve body 7*b* is at a completely open position at $t_{11}$.

Accordingly, the fuel pressure arising in the high pressure chamber 6 at this time changes as shown in FIG. 2H. This fuel pressure is transmitted through the injection pipe to the injection valve with the required delay time $t_y$ ($t=t_8$), and the injection of fuel is performed at $t=t_9$. FIG. 2J shows the waveform of a lift pulse PL which is output from the lift sensor 14 in response to the lifting of the needle valve due to the feel pressure shown in FIG. 2I. It can be understood from the waveform of the lift pulse PL that the needle valve is lifted at $t_9$ and the needle valve is seated on the corresponding valve seat at $t_{12}$.

It can also be understood from the FIGS. 2E through to 2J that the period $t_d$ between $t_6$ and $t_9$ is the injection delay time in this case. The injection delay time $t_d$ is measured in the measuring unit 15 every time the driving shaft has rotated once, and the correction data $D_c$ obtained on the basis of the results of this measurement is employed as data for controlling the next injection timing.

According to the above-mentioned construction, data TAD which represents the target injection timing and data $D_c$ which represents the injection delay are provided as converted into data representing the angle of the driving shaft 8, and the control of injection timing is performed based on the pulse signal $S_N$ which indicates the position of angular rotation of the driving shaft 8. Consequently, even if the speed of the diesel engine 2 suddenly changes, the accuracy in the control of injection timing will not be directly influenced. As a result, even in the case where control is performed with an internal combustion engine with numerous cylinders, it is sufficient for the sensor for detecting the actual injection timing etc. to be mounted only on one particular cylinder. Therefore, highly accurate control of injection timing can be performed with stability using a simple construction.

According to the present invention, since a timing signal indicating the desired target timing is output as the data represented by the angular position of the rotating member, the accuracy of the timing signal is hardly influenced at all even if a sudden change occurs in the rotation of the rotating device. The data representing the target timing is divided into a part which can be regulated by the graduation of the scale pulse using a determined timing based on the scale pulse, and a part which cannot be regulated so that timing is determined by time. Consequently, it has the advantage of outputting a timing signal with sufficiently high accuracy without greatly increasing the density of the generation of the scale pulse.

I claim:

1. A timing signal generating apparatus for rotating devices which outputs a timing signal showing that a rotating member of the rotating device has reached a target rotational angle position, said apparatus comprising:

means producing a first data representing a target rotational angle position as an angular position of said rotating member;

a first generating means generating scale pulses every time said rotating member rotates N degrees;

a second generating means generating a reference pulse used for discriminating a prescribed scale pulse from scale pulses generated by the first generating means;

a calculating means, responsive to the first data which performs a calculation in which the target rotational angle position is the dividend and N is the divisor and outputs first and second calculation data which are determined in relation to a quotient A and a remainder B, respectively, for producing first calculating data, a first means responsive to the reference pulse, the scale pulses and the first calculating data producing a first timing pulse indicating a timing when the rotating member has assumed a rotational angle position indicated by N x A; and a second means producing a second timing pulse with a pulse width determined according to the second calculating data in response to the first timing pulse.

2. The apparatus of claim 1 wherein said first generating means includes a first pulser which is secured to said rotating member and is provided with a plurality of cogs on its outer periphery at equi-angular intervals, and a first pick-up sensor which is located adjacent to the first pulser in such a way that the cogs come to face opposite the first pick-up sensor in sequence.

3. The apparatus of claim 2 wherein said second generating means has a second pulser which is secured to said rotating member and is provided with cogs on its outer periphery, and a second pick-up sensor which is located adjacent to the first pulser whereby the reference pulse is produced each time any one of the cogs of the second pulser comes to face the second pick-up sensor.

4. The apparatus of claim 2 wherein said second generating means has a second pulser which is secured to said rotating member and is provided with a single cog on its periphery, and a second pickup sensor which is located adjacent to the first pulser whereby the reference pulse is produced each time the single cog comes to face the second pickup sensor.

5. The apparatus of claim 4 wherein the first and second pulsers are secured to the rotating member in such a way that the single cog of the second pulser comes to face opposite the second pick-up sensor at the timing after the cog of the first pulser one prior to a predetermined cog of the pulser comes to face opposite the first pick-up sensor but before the predetermined cog comes to face opposite the first pick-up sensor, and the prescribed scale pulse is produced when the predetermined cog of the first pulser comes to face opposite the first pick-up sensor.

6. The apparatus of claim 1 wherein the first calculation data represents the quotient A and the second calculation data represents the remainder B.

7. The apparatus of claim 5 wherein said first means is responsive to the scale pulses and the reference pulse for outputting counting data relating to the number of pulses generated after the input of the reference pulse, and has a discriminating means for discriminating whether or not the counting data has become equal to the first calculating data, and means responsive to the scale pulses and an output of said discriminating means for taking out a scale pulse generated at the timing indicated by the first calculating data as the first timing pulse.

8. The apparatus of claim 5 wherein said second means is a pulse generator which is triggered by the first timing pulse to generate the second timing pulse with the pulse width determined by the second calculation data.

* * * * *